United States Patent [19]

Barten

[11] 4,366,419

[45] Dec. 28, 1982

[54] ASTIGMATIC ELECTRON LENS FOR A CATHODE-RAY TUBE

[75] Inventor: Piet G. J. Barten, Eindhoven, Netherlands

[73] Assignee: U.S. Philips Corporation, New York, N.Y.

[21] Appl. No.: 196,234

[22] Filed: Oct. 14, 1980

Related U.S. Application Data

[63] Continuation of Ser. No. 19,015, Mar. 8, 1979, which is a continuation of Ser. No. 812,716, Jul. 5, 1977, abandoned.

[30] Foreign Application Priority Data

Jul. 13, 1976 [NL] Netherlands ..... 7607722

[51] Int. Cl.[3] ..... H01J 29/58

[52] U.S. Cl. ..... 315/382; 313/414

[58] Field of Search ..... 315/382; 313/411, 412, 313/414, 460, 449, 458

[56] References Cited

U.S. PATENT DOCUMENTS

| | | | |
|---|---|---|---|
| 2,332,622 | 10/1943 | Calbick | 315/382 X |
| 3,146,373 | 8/1964 | Janssen | 315/382 |
| 3,176,181 | 3/1965 | Blackler et al. | 313/449 X |
| 3,504,211 | 12/1981 | Takemoto et al. | 315/31 TV |
| 3,610,992 | 10/1971 | Miyaoka | 313/460 X |
| 3,722,554 | 11/1973 | Hughes | 313/412 |

FOREIGN PATENT DOCUMENTS 889005 2/1962 United Kingdom .

*Primary Examiner*—Theodore M. Blum
*Attorney, Agent, or Firm*—Robert J. Kraus

[57] ABSTRACT

A focusing electron lens having a controllable astigmatism. An auxiliary electrode affects the non-rotationally symmetrical field defined by two tubular electrodes to vary the convergence in one main direction while maintaining it constant in the other main direction. In an in-line electron gun system in a color television display tube, such a lens corrects for the effect of parastigmatic, self-converging deflection coil systems on the focusing of the electron beams.

5 Claims, 4 Drawing Figures

ASTIGMATIC ELECTRON LENS FOR A CATHODE-RAY TUBE

This is a continuation of application Ser. No. 19,015, filed Mar. 8, 1979; which in turn is a continuation of Ser. No. 812,716, filed July 5, 1977 now abandoned.

BACKGROUND OF THE INVENTION

The invention relates to a cathode-ray tube having an astigmatic electron lens, comprising at least two electodes spaced axially from each other, and means for supplying a first and a second potential to the electrodes, one of the electrodes at its end facing the other electrode having means to form an axial non-rotationally symmetrical electrical field between the two electrodes. The invention also relates to a device having such a cathode-ray tube.

In a cathode-ray tube it is often desired to focus an electron beam more strongly in one direction than the other. This may be necessary, for example, to compensate for astigmatism of the deflection coil or of other electron lenses in the tube. This is necessary, for example, in colour display tubes with three electron beams in a common plane and a parastigmatic self-converging deflection coil. Such a deflection coil converges the individual electron beams in a direction normal to the plane through the electron beams. The resulting vertical overfocusing cannot be compensated for by dynamically controlling the strength of the usual focusing lens as a function of the deflection, as this is done in colour display tubes having three electron beams in a delta configuration and a non-astigmatic deflection coil, because in that case horizontal underfocusing would occur.

British Patent Specification 889,005 discloses a quadrupole lens which consists of two coaxial cylindrical electrodes. The innermost electrodes are provided with apertures through which the electrical field between the two cylinders can penetrate into the space in the innermost cylinder. As a result of this, an astigmatic quadrupole field is formed in the innermost cylinder and converges the electron beam in one direction and diverges it in the direction at right angles thereto.

British Patent Specification 574,056 discloses a focusing lens in which, as a result of the design of the edge of one of the two cylindrical electrodes, an axial non-rotationally symmetrical field is obtained which converges the electron beam in one direction more strongly than in the direction at right angles thereto.

SUMMARY OF THE INVENTION

It is the object of the invention to provide a cathode-ray tube with a focusing lens whose strength can be varied in a manner such that the focusing in one direction remains constant when the focusing in the direction at right angles thereto is varied.

For that purpose, the electron lens of the invention has an extra electrode means to which a third potential can be applied for the simultaneous control of the astigmatism and the strength of the electron lens.

In a cathode-ray tube according to the invention, a change in the strength of the astigmatic component of the lens also influences the rotationally symmetrical major field of the lens. The result of this is that, for example, an increase of the horizontal focusing by the astigmatic component of the lens field is compensated for by a decrease of the strength of the rotationally symmetrical component of the lens field, whereas the corresponding decrease of the vertical focusing by the astigmatic component of the lens field is intensified by the decrease of the strength of the rotationally symmetrical component of the lens field.

The non-rotationally symmetrical electrical field may be formed in a variety of known ways. In a suitable embodiment the electrode has diametrically located apertures or recesses opposite to which the extra electrode means are situated.

An astigmatic electron lens according to the invention is very suitable for focusing the electron beams in a cathode-ray tube having three electron beams in one plane.

An astigmatic electron lens according to the invention is furthermore very suitable for use in a cathode ray tube for displaying color pictures having three such electron lenses whose axes are adjacent each other in a plane. The extra electrode means is preferably common to the three electron lenses and is preferably formed by two plates which are arranged on either side of the electrodes parallel to said plane.

A device having such a cathode-ray tube, and in which the three electron lenses are accelerating lenses, is preferably characterized in that the means for forming a non-rotationally symmetrical electrical field is provided in the three electrodes with the lowest potential, and a potential which is substantially equal to that of the electrodes having the lowest potential in the case of non-deflected electron beams, and which increases with increasing deflection of the electron beams, is applied to the extra electrode means.

The invention will be described in greater detail with reference to the accompanying drawing.

DESCRIPTION OF THE PREFERRED EMBODIMENTS

Figure 1:
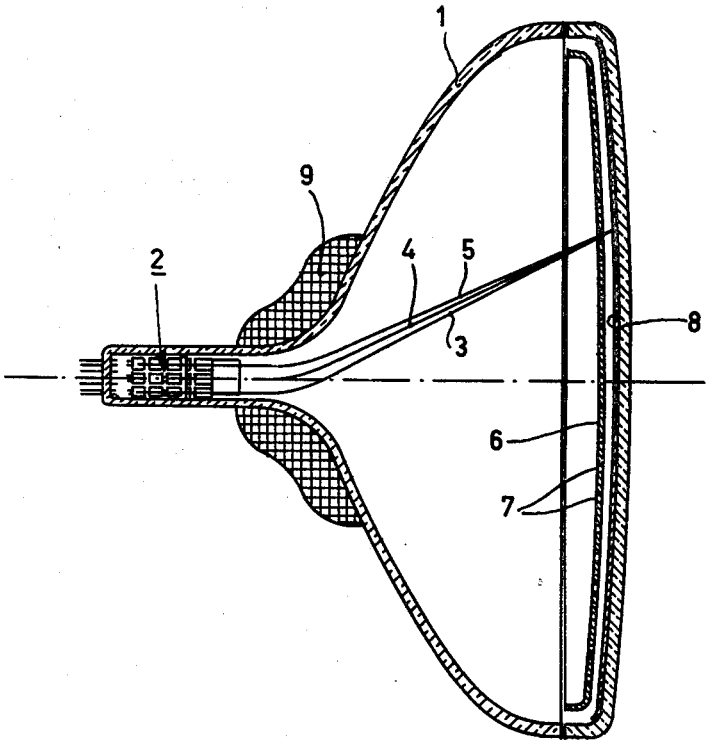
FIG. 1 shows a cathode-ray tube for displaying colored pictures having an astigmatic electron lens according to the invention.

The display tube for color television shown in FIG. 1 comprises, in a glass envelope 1, three electron guns 2 for generating electron beams 3, 4 and 5, a color selection electrode 6 having a large number of apertures 7, and a display screen 8. The tube furthermore has a set of deflection coils 9 for deflecting the electron beams 3, 4 and 5 over the display screen 8. The three electron beams 3, 4 and 5 are generated by the electron guns 2 in such manner that their axes are situated in one plane, the plane of the drawing of FIG. 1. The deflection coils 9 are manufactured so that the targets of the three electron beams 3, 4 and 5 remain coincident on the display screen 8 also upon deflection. Such parastigmatic, self-converging deflection coils, in combination with three electron beams in one plane, are known from the prior art and need not be described in detail.

An undesirable effect of such deflection coils is that they also converge the electron beams in a direction normal to the plane through the three beams. Since the plane through the three beams generally is horizontal, there is thus vertical overfocusing. Of course, the vertical overfocusing is zero when the electron beams are not deflected and increases with the deflection. This undesired vertical overfocusing can be compensated for by means of a dynamically controlled astigmatic lens such as a quadrupole lens whose strength, and hence the diverging effect in the vertical direction, increases with increasing deflection. In known constructions of such lenses, however, the horizontal convergence also increases with increasing deflection producing a horizontal overfocusing. The astigmatic electron lens according to the invention avoids such horizontal overfocusing. It should be noted that horizontal overfocusing could also be avoided with an individually controlled rotationally symmetrical focusing lens and a quadrupole lens. However, such an obvious solution is structurally more complicated and requires more space so that the length of the electron gun would increase if it were implemented. In an astigmatic electron lens according to the invention using one lens, the vertical overfocusing is compensated for while the horizontal focusing remains substantially constant.

Figure 2:
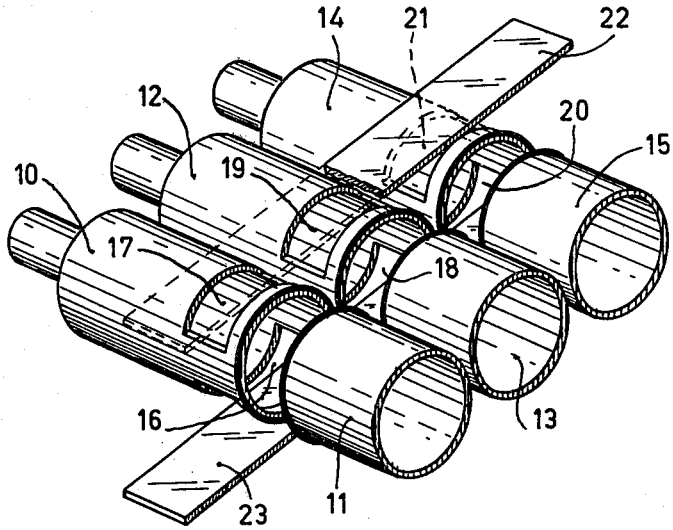
FIG. 2 shows a combination of three astigmatic electron lenses according to the invention.

FIG. 2 shows the main focusing lenses of the electron guns 2. The focusing lenses each comprise two cylindrical electrodes 10 and 11, 12 and 13, and 14 and 15, respectively. The electrodes 10, 12 and 14 each have a pair of apertures 16 and 17, 18 and 19, and 20 and 21, respectively, disposed directly opposite each other. An electrode 22 is situated opposite to the apertures 17, 19 and 21. An electrode 23 is situated opposite to the apertures 16, 18 and 20. The apertures 16, 21 are positioned sufficiently near the slots between the electrodes 10, 12 and 14 on the one hand and 11, 13 and 15 on the other hand, that the potential of the electrodes 22 and 23 influences the electric field in the slots through the apertures 16–21. As a result, quadrupole lenses of variable strength are formed in the electrodes 10, 12 and 14.

In the embodiment shown in FIG. 2 the electrodes 10, 12 and 14 are at a lower potential then the electrodes 11, 13 and 15. The focusing lenses are thus accelerating lenses. By increasing the potential of the electrodes 22 and 23 from a value substantially equal to the potential of the electrodes 10, 12 and 14 to values between the potential of the electrodes 10, 12 and 14 and the potential of the electrodes 11, 13 and 15, a quadrupole lens having an increasing strength which in the vertical direction exerts a diverging effect and in the horizontal direction exerts a converging effect is formed in the electrodes 10, 12 and 14 and the strength of the focusing lenses is reduced. These two effects result in a decrease of the vertical focusing and a constant horizontal focusing. The time-dependent potential of the electrodes 22 and 23 is chosen to be such that the decrease of the vertical focusing compensates for the vertical overfocusing of the deflection coils 9. In principle, the potential at the electrodes 22 and 23 should be quadratically dependent on the deflection.

Figure 3:
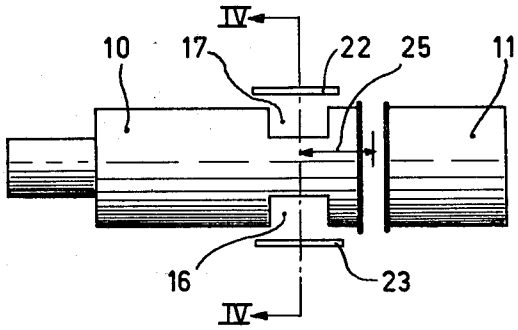
FIG. 3 is a side elevation of the lenses shown in FIG. 2.
Figure 4:
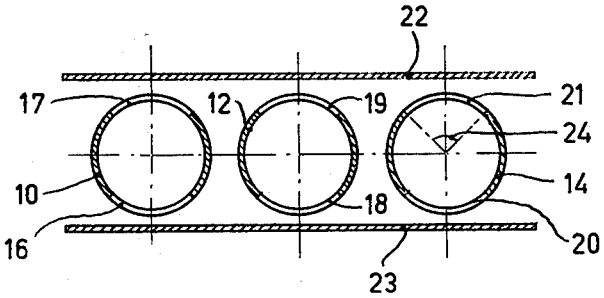
FIG. 4 is a sectional view at right angles to the axes of the electron beams of the lenses shown in FIG. 2.

For further explanation, FIG. 3 is a side elevation and FIG. 4 a sectional view of the electron lenses. The inside diameter of the electrodes 10–15 is 7.6 mm. The distance between the electrodes 22 and 23 is 9.5 mm. The axial length of the slot between the electrodes 10 and 11, 12 and 13, and 14 and 15, respectively, is 1.0 mm. The axial length of the apertures 16–21 is 3.0 mm. The angular dimension 24 of the apertures 16–21 in a plane at right angles to the axis is 90°. The distance 25 from the center of the apertures 16–21 to the center of the focusing slot is 4.5 mm. The potential of the electrodes 10, 12 and 14 is 4.3 kV. The potential of the electrodes 11, 13 and 15 is 25 kV measured with respect to the cathodes of the electron guns. The potential of the electrodes 22 and 23 is 4.3 kV when the electron beams 3,4 and 5 are not deflected and increases to 4.5 kV at a deflection angle of 55° of the electron beams 3, 4 and 5. The further construction of the electron guns 2 is conventional and thus need not be described in detail.

The potential at the electrodes 22 and 23 is generated by superimposing a parabolic alternating voltage dependent on the deflection and having an average value of zero V on a voltage which is equal to the voltage at the electrodes 10, 12 and 14. As a result of this, the voltage at the electrodes 22 and 23 increases quadratically with increasing deflection from 4.3 kV to 4.5 kV. No separate direct voltage component need be generated for the voltage at the electrodes 22 and 23, and the variable component of the voltage at the electrodes 22 and 23 can be generated with a simple alternating current circuit.

I claim:

1. In an electron gun assembly including a cathode, first and second axially arranged tubular electrodes extending in that order from said cathode, at least one of said electrodes being non-rotationally symmetrical, and means for applying a substantially fixed potential between said first and second tubular electrodes whereby an electric field is produced which defines an astigmatic lens for focusing an electron beam emitted from the cathode and passing through said field, the improvement comprising a further electrode means positioned to influence said electric field, and means for applying a time varying voltage between said further electrode means and said first tubular electrode, whereby said further electrode means simultaneously varies the astigmatism and strength of said lens.

2. An electron gun assembly as claimed in claim 1, wherein said tubular electrodes are cylindrical and are coaxially arranged, said first electrode has two diametrically opposed apertures in the wall thereof adjacent an end of said first electrode toward said second electrode, and said further electrode means includes two further electrodes adjacent said apertures respectively, said means for applying a time varying voltage applies an identical voltage to each of said further electrodes, and said apertures and electrodes are arranged such that the time varying voltage affects focus along a direction extending between said apertures without affecting focus in a direction orthogonal to said direction and the direction of said electron beam.

3. In a cathode ray tube a system having a display screen and an electrode system for generating at least one electron beam directed onto said screen, said electrode system including an electron gun assembly comprising a cathode, first and second axially-arranged tubular electrodes extending in that order from said cathode, at least one of said electrodes being nonrotationally symmetrical, and means for applying a substantially fixed potential between said first and second tubular electrodes whereby an electric field is produced which defines an astigmatic lens for focusing an electron beam emitted from the cathode and passing through said field, the improvement comprising a further electrode positioned to influence said electric field, and means for applying a time-varying voltage between said further electrode and said first tubular electrode, whereby said further electrode simultaneously varies the astigmatism and strength of said lens.

4. The cathode ray tube system of claim 3 wherein said first tubular electrode has an aperture formed through a wall of the end portion thereof adjacent said second tubular electrode, and said further electrode is arranged adjacent said aperture.

5. The cathode ray tube system of claim 3 or 4 wherein the time-varying voltage applied to said electrodes increases with increasing deflection of said beam from the axis of the tube.

* * * * *